US005758972A

United States Patent [19]

Mack et al.

[11] Patent Number: 5,758,972

[45] Date of Patent: Jun. 2, 1998

[54] ASSISTED SUNDRIES CADDY BED BASED HOLDING SYSTEM

[76] Inventors: Deborah K. Mack, 4656 Nine Oaks Cir.; Tamara W. Starkey, 4825 W. 94th St., both of Bloomington, Minn. 55437

[21] Appl. No.: 720,947

[22] Filed: Oct. 4, 1996

[51] Int. Cl.[6] ..... B65D 33/14

[52] U.S. Cl. ..... 383/11; 5/694; 248/205.2

[58] Field of Search ..... 5/308, 503.1, 658, 5/693, 694; 248/305.2; 206/449; 383/11, 39, 86

[56] References Cited

U.S. PATENT DOCUMENTS

| | | | |
|---|---|---|---|
| 3,321,068 | 5/1967 | Beach | 248/205.2 |
| 3,415,300 | 12/1968 | Worcester | 383/11 |
| 4,079,767 | 3/1978 | Howard | 383/86 |
| 5,181,555 | 1/1993 | Chruniak | 383/11 |
| 5,286,112 | 2/1994 | Bible | 383/86 |
| 5,370,246 | 12/1994 | Traynor | 383/11 |
| 5,495,971 | 3/1996 | Holliday | 383/39 |
| 5,664,673 | 9/1997 | Perry | 248/205.2 |

*Primary Examiner*—Jimmy G. Foster
*Attorney, Agent, or Firm*—Kinney & Lange, P.A.

[57] ABSTRACT

A sundries caddy to hold sundries for use with a with a fastening arrangement in being suspended from a bed. A suspendable container portion of the caddy is held by a clampable portion over the edge of a mattress support by a mismatched hooks and loops patches fastener adhered to the mattress support supplemented by the pressure of the mattress thereon and on much of the remainder of the clampable portion.

6 Claims, 3 Drawing Sheets

ASSISTED SUNDRIES CADDY BED BASED HOLDING SYSTEM

BACKGROUND OF THE INVENTION

The present invention relates to suspended containers, or caddies, for sundries and, more particularly, to a holding system providing such suspension.

Modern society has been noted by many commentators to have become increasingly more hectic. Many people find themselves noticeably more harried in their lives, and often are engaged in activities more hours of the day than in the past thereby leading to less leisure time.

One of the pleasures of life in these circumstances for many people is taking a period of time to relax in bed at the end of day prior to beginning sleep. A substantial fraction of those people give this period of relaxation time over to reading from a book or a magazine, working on a puzzle, or writing letter, etc.

In the absence of nearby shelves or a nightstand, or because such shelves or nightstand tops are already filled or covered with other objects, such books and magazines, or other related items, oftentimes are left on the floor near the bed after the reader chooses to begin sleeping until the next night. The end result in many situations is the presence of a few books or magazines or other items on the floor, or even a stack of such items on the floor near the reader's bed. This result can hinder both cleaning near the bed and the making of the bed, and also give the vicinity of the bed a slovenly look detracting from the appearance of the room. Such a result can be overcome by the use of a suspended container, or caddy, which can hang from the side of the bed for the purpose of containing such books or magazines, or the like, but which is subject to being covered by the bedding to thereby be out of sight.

Due to the weight of several books or magazines, or other items, in such a caddy, a fastening system for suspending that caddy at the side of the bed over the floor must be able to withstand a substantial weight load without having the caddy becoming disengaged from the bed to then fall to the floor. Yet, such a caddy must be readily removable from the bed to ease the making of the bed in some circumstances, the cleaning of the mattress and box spring, the cleaning of the caddy itself, etc. Furthermore, the fastening system and caddy must be convenient to install on the bed if the ordinary consumer is to do so without undue difficulty. Thus, there is a desire for an effective fastening system for such a caddy to allow removably suspending it from a bed.

SUMMARY OF THE INVENTION

The present invention provides a sundries caddy to hold sundries for use with a with a fastening arrangement providing for suspension from a bed. A suspendable container portion of the caddy is held by a clampable portion thereof, over the edge of a mattress support, by a hooks and loops patches kind of fastener that is affixed thereto and adhered to the mattress support so as to be supplemented by the pressure of the mattress thereon and on much of the remainder of the clampable portion. The patches differ in extent sufficiently to allow the manual pulling of the caddy from the mattress support without delaminating the strip adhered to that support, but less than that extent difference which would lead to the weight of the sundries pulling it from the support in the presence of the mattress thereover and over the clampable portion area.

DETAILED DESCRIPTION OF THE PREFERRED EMBODIMENTS

Figure 1:
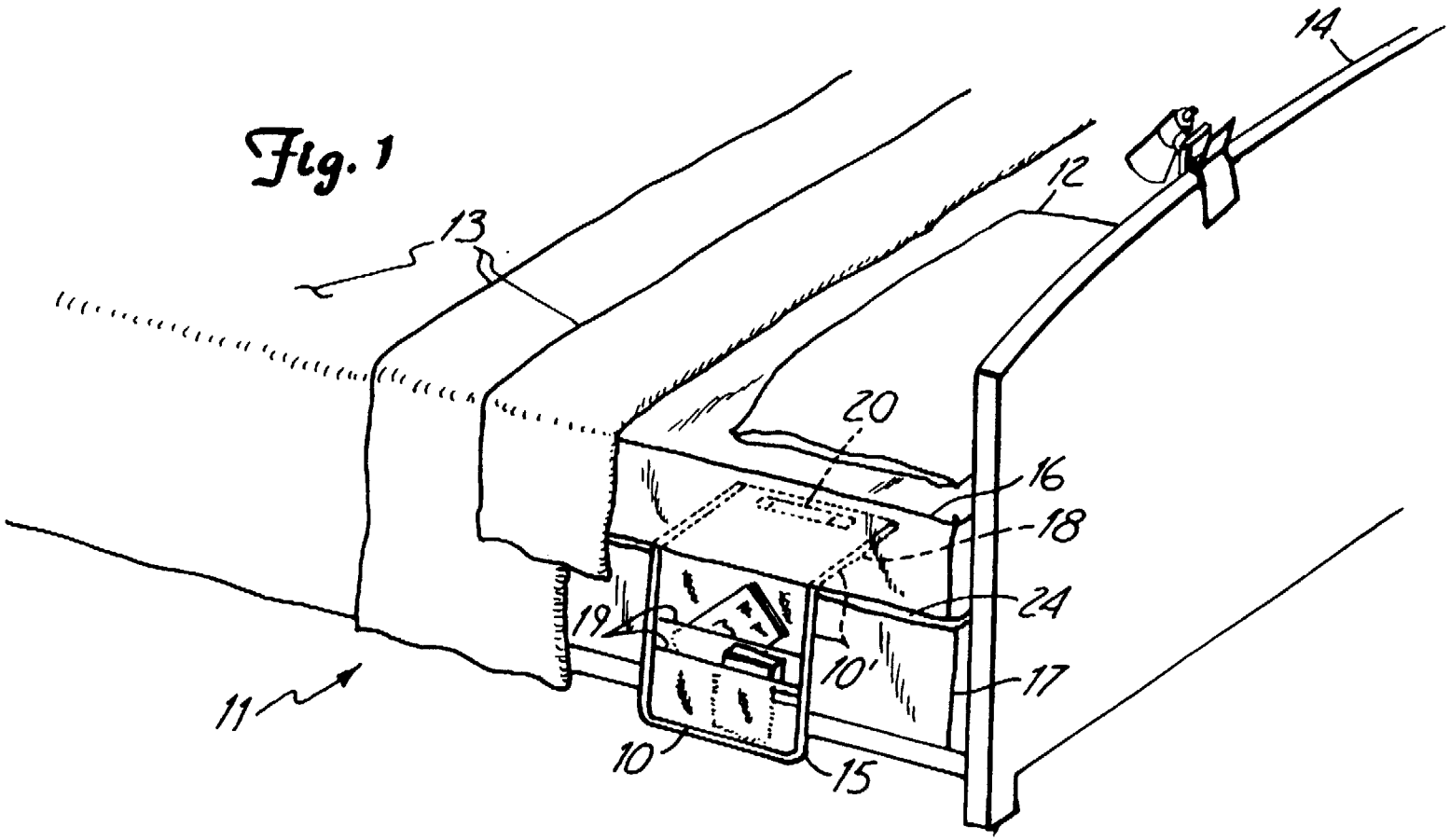
FIG. 1 shows a bed with the bedcovers partially pulled back to reveal an installation embodying the present invention.

FIG. 1 shows a container, or caddy, 10, suspended in part from the side of a bed, 11. A pillow, 12, is revealed along with caddy 10 by the result of the pulling back of bedcovers, 13, these bedcovers being pulled back from the bed headboard, 14. Caddy 10 is fabricated on a backing material or carrier, 10', provided in the form of a flexible, extended sheet which is typically a textile material. Caddy 10 has a suspended or hanging portion, 15, with carrier 10' as a part thereof, hanging below a sheet-covered mattress, 16, and down past some or all of a box spring or bed platform, 17. A further portion, 18, of caddy 10, also having carrier 10' as a part thereof, extends horizontally in FIG. 1 between mattress 16 and box spring or platform 17 to be clamped therebetween with that fraction thereof covered by mattress 16 being shown in dashed line form.

Suspendable portion 15 is shown with a pair of overlapping pockets, 19, having assorted books and magazines or other items contained therein. Rather than a pair of pockets, a single pocket could be provided or, alternatively, three or more pockets could instead be provided. The outer walls of pockets 19 are of a textile material similar to, or the same as, that used in carrier 10', and they are sewn to that carrier. Thus, the inner pocket outer wall forms a partially enclosed space with carrier 10' to thereby provide the inner pocket or holding space, and the outer wall of the outer pocket forms a partially enclosed space with the outer wall of the inner pocket to similarly provide the outer pocket. A textile bias tape, or edging, is folded over the edges of carrier 10' and sewn thereto to provide a finished look and to reduce fraying of the carrier 10' material.

Figure 2:
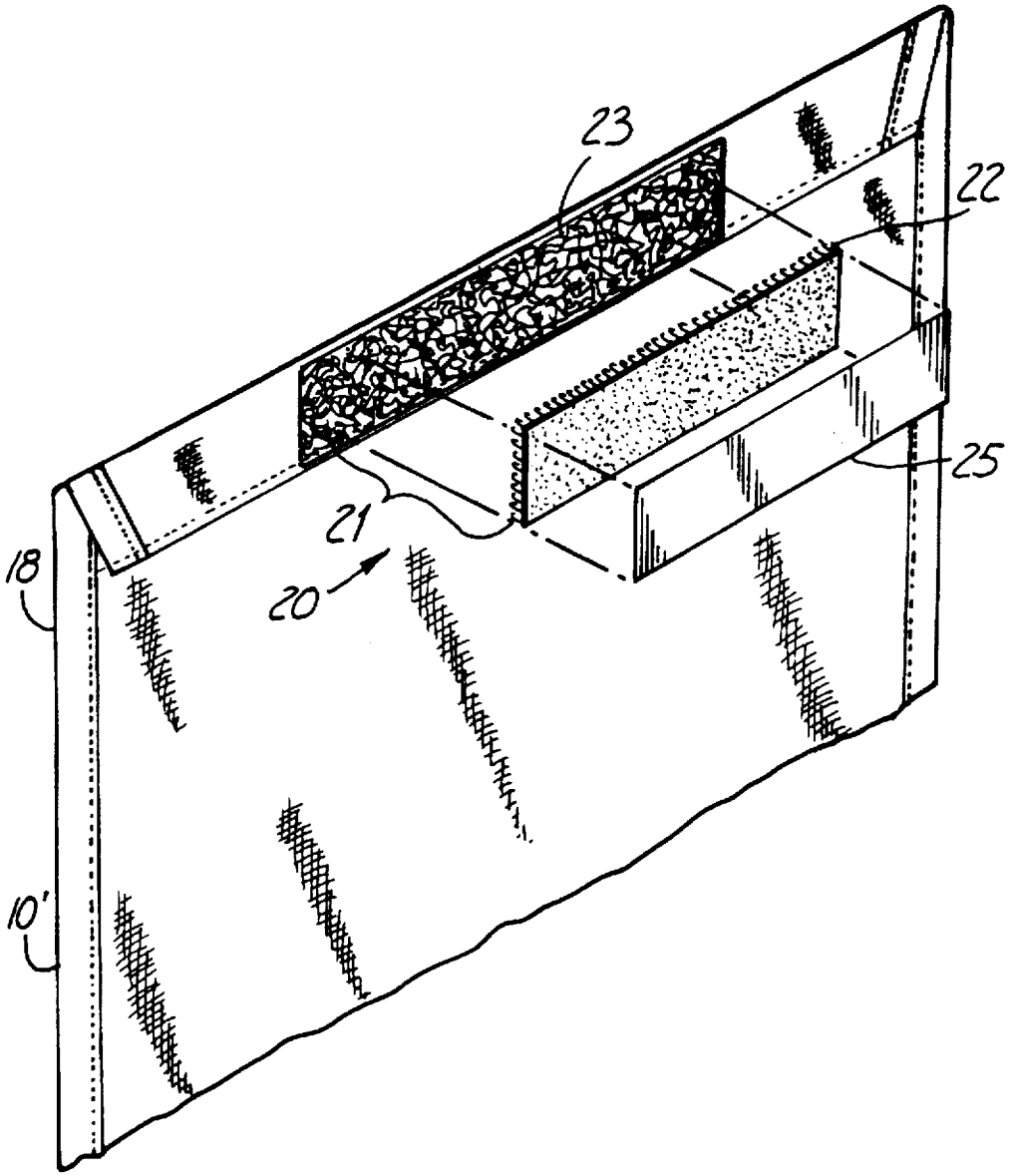
FIG. 2 shows a fragmentary view of a portion of the installation of FIG. 1.

Clampable portion 18 of caddy 10 has a fastening apparatus, 20, shown in dashed line form, provided therewith located near, and centered on, the edge thereof furthest from hanging portion 15. That is, fastening apparatus 20 is located well inward toward the opposite side of the bed from the edge of box spring or platform 17 over which suspended portion 15 of caddy 10 hangs. Fastening apparatus 20 comprises a SCOTCH™ Joining System fastener, or "hooks and loops" fastener, 21, available from the Minnesota Mining and Manufacturing Company of Saint Paul, Minn., and is shown in more detail in FIG. 2. Fastener 21 has a first member formed of a "hooks" patch, 22, in the form of a strip with many flexible hooks extending outward from a side thereof, and a second member formed of a "loops" patch, 23, also in the form of a strip with a pile having many loops extending outward from a side thereof. When pressed together, the hooks in hooks strip 22 become entangled with the fibrous loops looping outward from loops strip 23. This entanglement of hooks and eyes provides a fairly strong mechanical bond between strips 22 and 23, but one which is subject to becoming undone to thereby disengage the fastener members from one another through a sufficient pulling force being applied to loops strip 23 to pull the resilient hooks on strip 22 out of the loops of strip 23.

Loops strip 23 is sewn to the textile or cloth material of carrier 10' in clampable portion 18 of caddy 10 to strongly affix it thereto without the use of an adhesive. Although a hooks strip could instead be affixed to clampable portion 18, loops strip 23 is chosen at this location because of offering a softer feel to one handling caddy 10 than would the stiffer hooks of a hooks strip, and because loops strip 23 is less likely to snag other objects during washings of caddy 10 than a hooks strip. Alternatively, an adhesive bond could be made between loops strip 23 and clampable portion 18. Such an adhesive could bond this strip quite well to clampable portion 18 of caddy 10 because the strip would be adhered to this portion at the time of manufacture when the surface properties and cleanliness of the cloth material in that portion can be well controlled. That is, the kind of the material, its cleanliness, surface finish, coatings and other conditions are readily controllable at the factory to assure that the chosen adhesive bonds strongly thereto. As a further alternative, both of these kinds of affixation could be used.

Hooks strip 22, however, must be adhesively bonded to bed spring or platform 17 by the user at the time caddy 10, theretofore unused, is to be first put into service by that user. Economics, convenience and the need for removability dictate that a pressure-sensitive adhesive be used for this purpose rather than a more capable adhesive providing a greater adherence, but requiring a more complicated application procedure and perhaps special tools or steps while being less subject to convenient removal. Such a pressure-sensitive adhesive of a suitable kind and amount is supplied to the user through that adhesive being applied to the back of strip 22, typically through having it coated thereon.

In these circumstances, the nature of upper surface, 24, of box spring or platform 17 will not be in the control of the manufacturer. The presence of dust or dirt or other contaminant on surface 24, or of a stain or dirt prevention film coated thereon, or the nature of the cloth used in the covering for a box spring will be unknown to the manufacturer with the result that the adhesive provided on the back of strip 22 cannot be chosen to optimally match the characteristics of that surface. Such contaminants or stain prevention films, if present, can serve as a release agent significantly weakening the adhesive bond between strip 22 and surface 24. Similarly, the nature of the cloth covering of box spring 17 or the nature of surface 24 of the platform used in place thereof, can be such as to provide a poor base for the adhesive being used to adhere strip 22 thereto.

Figure 3:
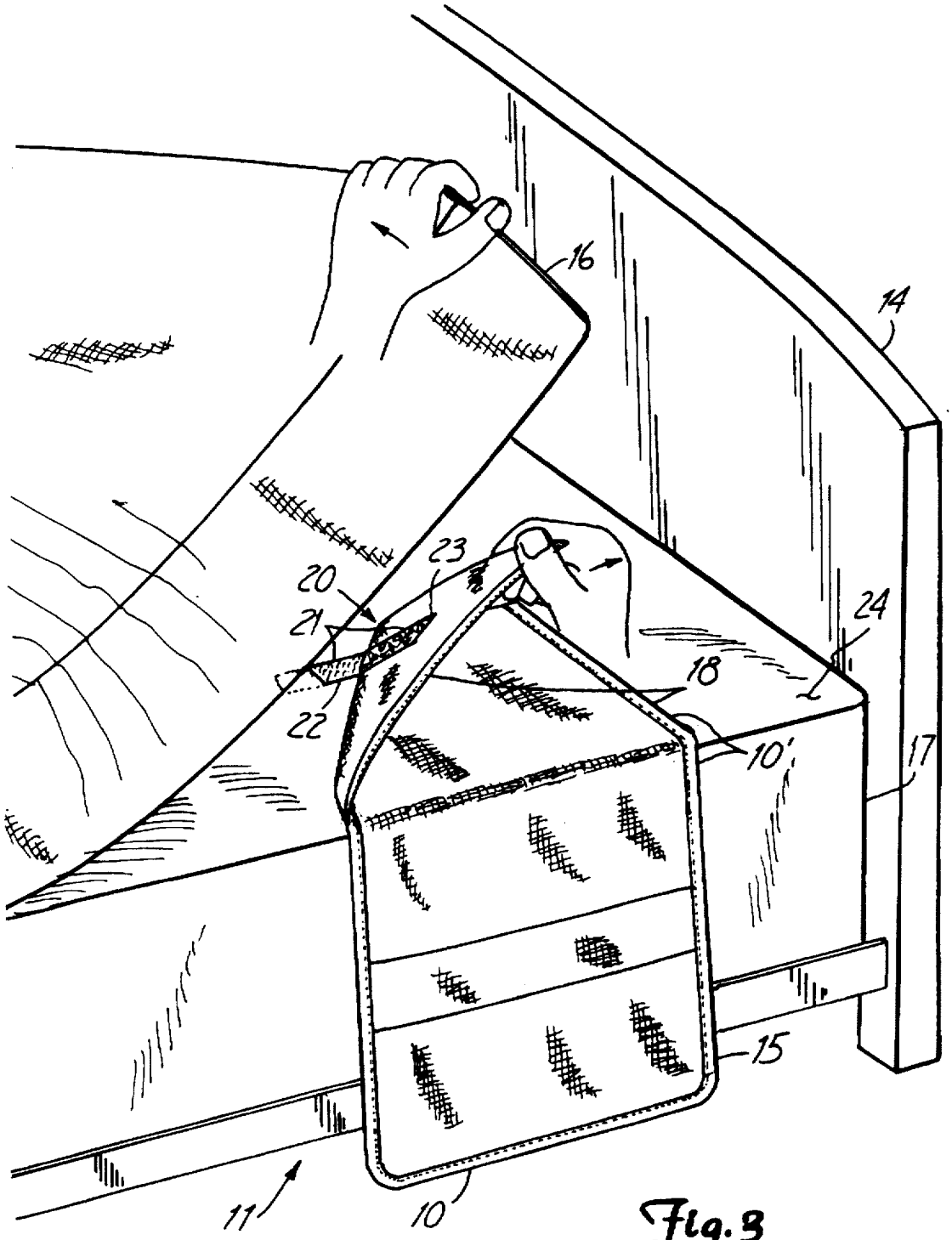
FIG. 3 shows the installation of FIG. 1 in the process of being temporarily and partially removed from the bed.

As a result, when the user comes at a later time to manually remove caddy 10 from box spring or platform 17 for some purpose through pulling on the edge of caddy 10 as indicated in FIG. 3, fastening apparatus 20 may very well separate entirely from surface 24 of box spring or platform 17 by peeling away therefrom, or delaminating, rather than splitting apart at the interface between that strip and loops strip 23 as desired. Such a result is due to an adherence failure of the adhesive between strip 22 and surface 24 under peel forces. Repeats of such a result in subsequent further removals will soon render this adhesive less capable of adhering to surface 24 as it becomes more and more contaminated by additional dust and dirt each time it separates from that surface.

Thus, such a result is to be avoided. Pressure-sensitive adhesives are relatively inferior in resisting peel forces as compared to their ability to resist tensile forces, so that keeping mostly tensile forces present at the adhesive during a removal of caddy 10 is needed. Similarly, hooks strip 22 and loops strip 23 can be disengaged with less force in peeling them apart rather than by pulling them apart, i.e. a smaller magnitude of peel force is needed to separate them than would be required for a tensile force to do so. If the edges of each of these strips are aligned with one another at the beginning of an effort to pull them apart, there will be mostly tensile forces at both the adhesive and the interface between the two strips since, initially, neither strip will have any portion thereof at a significant angle with respect to the other nor to surface 24.

Since the tensile force yield point for the interface between the two strips can in many circumstances be greater than that between the adhesive on strip 22 and surface 24 of support structure 17, this adhesive will fail in those circumstances to continue to adhere to surface 24 at the edge thereof in alignment with strip 23. Once such a failure occurs, and the removal pulling, force shifts to an angle with respect to the normal to surface 24, the force at the adhesive interface with surface 24 is quickly converted to becoming increasingly a peel force to thereby result in pulling hooks strip 22 from surface 24. Thus, the initial force at the interface between strips 22 and 23 should be substantially a peel force rather than substantially all tensile force so that separation will be certain to begin there, rather than having the possibility that it will begin at surface 24 as just described.

This result can be achieved by reducing the length of strip 22 with respect to the length of strip 23 so that the edges of each are not aligned with one another across the direction in which pulling occurs when a user is in the process of manually separating caddy 10 from bed structure 17. In this arrangement, clampable portion 18 and loops strip 23 will already be bent rather sharply over themselves in the direction of pulling when the pulling force first comes to be applied to the interface between the two strips through clampable portion 18 and loops strip 23, and so a significant peel force will be applied to strip 23 just past the bend therein at this interface. At the same time, the force at the interface between the adhesive on strip 22 and surface 24 will be primarily tensile, since strip 23 will have no significant angle with respect to surface 24. This situation leaves the interface between the strips to yield before the interface between the adhesive on strip 22 and surface 24 because of the lower peel force yield value of the strips interface compared to the tensile force yield value at the surface 24 interface.

Although this shortening of the length of one strip with respect to the length of the other is effective in reducing or eliminating the problem of delamination of hooks strip 22 from surface 24 of bed structure 17, it gives rise to another problem. The shortening of the length of one strip with respect to the other leaves less interface area between the two strips for the hooks and loops to be entangled so that there is less holding strength between these strips to support large loads in pockets 19 that tend to pull caddy 10 at loops strip 23 from hooks strip 22 as bonded to surface 24. The result of having caddy 10 fall to the floor in face of substantial loadings of pockets 19 could, of course, be avoided by enlarging both strips sufficiently while keeping the edges thereof crossing the likely pull directions unaligned, but this is a relatively expensive solution and significantly increases the force required manually remove caddy 10 at loops strip 23 from hooks strip 22 for the purposes describe above.

An alternative is used for caddy 10 by having, instead, the interface area between strips 22 and 23 only large enough to hold anticipated loads in pockets 19 in conjunction with the supplementary effects of the weight of mattress 16 in a) bearing on these strips to increase the effective separation force between these strips, as experienced at pockets 19, and in b) bearing on the rest of clampable portion 18 to increase the resting frictional force between that portion and both mattress 16 and surface 24 of bed support 17. That is, the area of clampable portion 18 can be increased as needed to increase the resting frictional force between that portion and both mattress 16 and surface 24, at least to the point where use of caddy 10 would become inconvenient, and can be done much more economically than increasing the areas of strips 22 and 23. Further, the added holding force for suspended portion 15 with loads in pockets 19 due to the presence of mattress 16 on clampable portion 18 and fastener 20 is removed upon lifting mattress 16 so that the manual removal of caddy 10 does not require a large pulling force to remove strip 23 from strip 22 as would be required if the overlapping interface between them was large.

Thus, the fastening arrangement employed with caddy 10 involves several components including fastening apparatus 20, horizontal or clampable portion 18 of caddy 10, and both mattress 16 and box spring or platform 17. The user of caddy 10, at a time at which it is previously unused, must apply hooks strip 22 to surface 24 of box spring or platform 17 using the adhesive coated on that strip to provide this fastening arrangement. This adhesive on hooks strip 22 is covered by a coated paper or plastic liner, 25, shown in FIG. 2 prior to mounting on surface 24 to protect it from contamination, and must be removed prior to the adhering of that strip to surface 24.

Although the present invention has been described with reference to preferred embodiments, workers skilled in the art will recognize that changes may be made in form and detail without departing from the spirit and scope of the invention.

What is claimed is:

1. A sundries caddy for storing sundries therein, suspended from underneath a mattress on a support structure in a bed, said caddy comprising:

a carrier formed of a flexible material having a suspendable portion comprising at least one holder formed by restraints that at least partially encloses a holding space, and a clampable portion having a selected area; and a fastener formed of a plurality of patches including a loops patch formed of a backing having a pair of major sides opposite one another with a looped pile extending from one said major side thereof opposite a mounting major side thereof, and further including a hooks patch differing in extend from said loops patch formed of a further backing having a pair of major sides opposite one another with a plurality of flexible hooks extending from one major side thereof opposite a mounting major side thereof, said flexible hooks being capable of entangling said loops when forced thereagainst to fasten said loops and hooks patches together and of disentangling therefrom when forced apart with sufficient force, a selected one of said loops and hooks patches having said mounting major side thereof affixed to said clampable portion at a selected location thereon, said one of said loops and hooks patches remaining having a mounting adhesive on said major mounting side thereof adhered to said support structure, said caddy being fastened to said support structure by pressing said loops and hooks patches together with said difference in extent between said loops and hooks patches permitting edges across a pulling direction to be sufficiently separated so that manual removal of said caddy from said support structure by pulling in said pulling direction results in forcing apart said hooks and loops patches rather than removing from said support structure that said patch adhered thereto, said difference in extent also being sufficiently small and said area of said clampable portion being sufficiently great so that, with said mattress on said clampable portion fastened as aforesaid to said support structure, a selected accumulated weight of said sundries contained in said holding space is insufficient to pull said caddy from said bed support structure.

2. The apparatus of claim 1, wherein that one of said loops and hooks patches for adhering to said bonding surface of said support structure has said mounting adhesive thereon formed of a pressure-sensitive adhesive.

3. The apparatus of claim 1 wherein said hooks and loops patches are formed as strips each being substantially longer than wide with one of them being substantially longer than that one remaining.

4. The apparatus of claim 1 wherein multiple holders are formed in said suspendable portion.

5. The apparatus of claim 3 wherein that one of said hooks and loops strips adhered to said clampable portion is longer than one remaining.

6. The apparatus of claim 5 wherein said loops strip is affixed to said clampable portion and said hooks strip is adhered to said bonding surface of said support structure.

* * * * *